US007377059B1

(12) United States Patent
Bertollo

(10) Patent No.: US 7,377,059 B1
(45) Date of Patent: May 27, 2008

(54) IRONING BOARD

(75) Inventor: Domenico Bertollo, Pianezze San Lorenzo (IT)

(73) Assignee: BMI Bertollo S.r.l., Pianezze San Lorenzo (IT)

( * ) Notice: Subject to any disclaimer, the term of this patent is extended or adjusted under 35 U.S.C. 154(b) by 0 days.

(21) Appl. No.: 11/752,682

(22) Filed: May 23, 2007

(51) Int. Cl.
*D06F 81/02* (2006.01)
*D06F 81/00* (2006.01)

(52) U.S. Cl. ..... 38/137

(58) Field of Classification Search ..... 38/103, 38/141, DIG. 1, DIG. 3; 108/117, 118, 120, 108/127; 280/30
See application file for complete search history.

(56) References Cited

U.S. PATENT DOCUMENTS 1,601,250 A * 9/1926 Hilderbrand ..... 280/30
2,998,663 A * 9/1961 Boardman et al. ..... 108/117
4,433,497 A * 2/1984 Foster et al. ..... 38/107
6,151,817 A * 11/2000 Eiben ..... 38/135
6,643,960 B2 * 11/2003 Manfiotto ..... 38/137

FOREIGN PATENT DOCUMENTS

JP 2004121471 A * 4/2004
WO WO03018900 A1 * 3/2003

* cited by examiner

*Primary Examiner*—Ismael Izaguirre
(74) *Attorney, Agent, or Firm*—Browdy and Neimark

(57) ABSTRACT

Improved ironing board which comprises an ironing surface supported by a frame having two legs which can be moved between an open configuration, where they support the ironing surface in a working position, and a closed configuration, where they are folded up against the bottom side of the board, for stowing away the ironing board. A carriage is mounted slidably on the bottom side of the ironing surface at one of its ends, having a pair of idle mounted wheels and being operated by the movement of the frame so as to be displaced between a retracted position with the frame open, where the wheel retracts substantially into the contour of the ironing surface, and a projecting position, with the frame closed, where the wheel projects from the contour of the ironing surface so as to allow displacement of the board resting on the wheel.

7 Claims, 3 Drawing Sheets

IRONING BOARD

The present invention relates to an improved ironing board according to the preamble of the main claim.

In the technical field in question it is known that there exists the need to provide ironing beards which are convenient and easy to handle as regards transportation. In particular, when choosing a board, the user attaches particular importance to practical features such as the ease of moving the board between the room where the ironing operations are performed and the storage location, usually with the legs folded up against the board so as to allow it to be rested against a wall or against a surface.

The practical nature of transportation must not, however, negatively affect the stability of the board during the ironing operations, since poor stability could result in an increase in ironing time and/or less precise ironing of the garments.

It is known from GB 2216073 to use an ironing board which has a pair of wheels which are situated at the bottom ends of the front legs and which allow the board to be moved both in an open position, by raising the rear part of the board, and in the closed position, by resting the board on the wheels which for this purpose extend beyond the volume of the said board.

The ironing board described in the U.S. Pat. No. 2,701,425 has a rear leg with a support foot transverse to the extension of the board and provided with two wheels which remain in contact with the ground both when the legs are open and the board is in the operative ironing condition and when the legs are folded up against the bottom side of the board and the board is in the closed position so that it may be stowed away by means of movements which keep the board inclined with the weight which is transmitted onto the wheels.

The wheels have an associated locking and release mechanism which enables or disables rotation of the wheels for the various functional features.

The wheels are provided with stop devices to which the weight of the board is transmitted when the latter is in the stowed-away configuration and vertical position, in order to prevent the board from sliding on the ground, keeping it for example in the vertical position resting against a wall.

The U.S. Pat. No. 2,998,663 describes an ironing board which has a rear leg with a support foot transverse to the extension of the board and provided with two wheels which remain raised from the ground when the legs are open and the board is in the operative position and instead come into contact with the ground, allowing displacement of the board, when the legs are folded up against the bottom side of the board which is in the closed position so that it may be stowed away. The movement permitted by the abovementioned wheels is in this case transverse with respect to the direction of extension of the board, namely in a direction parallel to its short side.

The patent WO 03/018900 describes an ironing board which has a pair of rear legs which are joined together by a transverse support foot forming a continuation of the two legs and provided with two wheels which remain raised from the ground when the legs are open and the board is in the operative position and instead come into contact with the ground, allowing displacement of the board when the board is raised slightly from the ground in order to allow movement thereof while remaining in the open configuration.

The displacement permitted by the wheels is in this case parallel with respect to the direction of extension of the board, namely in a direction parallel to its long side.

The designs of ironing boards known hitherto in practice have proved to be not without drawbacks. In particular, the movement of the board in the closed configuration is still somewhat problematic and moreover cannot be performed in the case where the legs do not project beyond the dimensions of the contour of the board.

Therefore, in this situation the main object of the present invention is to provide an improved ironing board which has a considerable stability in the operative ironing position and which at the same time allows it to be easily transported and handled in the closed position.

Yet another object is to provide an ironing board which is inexpensive to produce and operationally entirely reliable.

These objects, together with other objects, are all achieved by the improved ironing board which comprises: an ironing surface which has a main direction of extension along a longitudinal axis (Y) and delimits a bottom side and a top side for ironing and at the ends a front portion and a rear portion; a frame able to support the ironing surface, comprising at least one first leg and one second leg and able to be moved between an open configuration where it supports the ironing surface in the working position and a closed configuration with the legs folded up against the bottom side of the board for stowing away the ironing board.

According to the invention, the ironing board is characterized in that it comprises at least one carriage mounted slidably on the bottom side of the ironing board at one of its ends, provided with at least one idle mounted wheel and operated by the movement of the frame so as to be displaced between a retracted position with the frame open, where the wheel retracts substantially into the contour of the ironing surface, and a projecting position, with the frame closed, where the wheel projects from the contour of the ironing surface so as to allow displacement of the board resting on the wheel.

The technical features of the invention, according to the abovementioned objects, may be clearly determined from the contents of the claims indicated below and the advantages thereof will emerge more clearly from the detailed description below, provided with reference to the accompanying drawings, which show a purely exemplary and non-limiting embodiment thereof in which:

Figure 1:
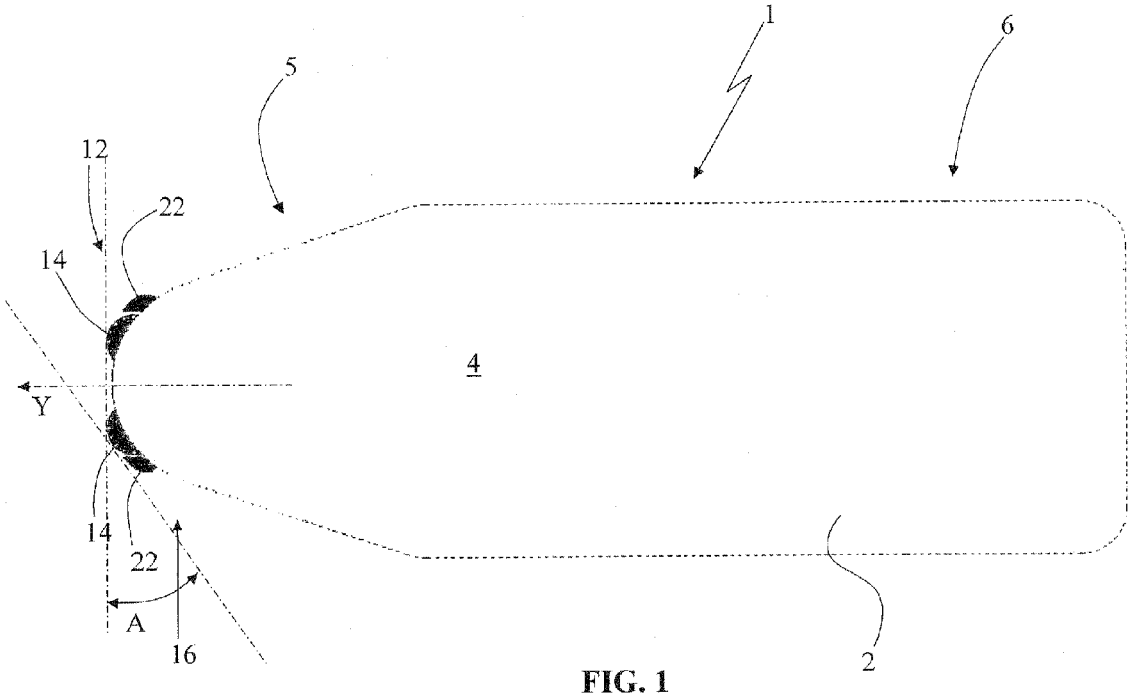
FIG. 1 shows a plan view of the improved ironing board according to the present invention.
Figure 5:
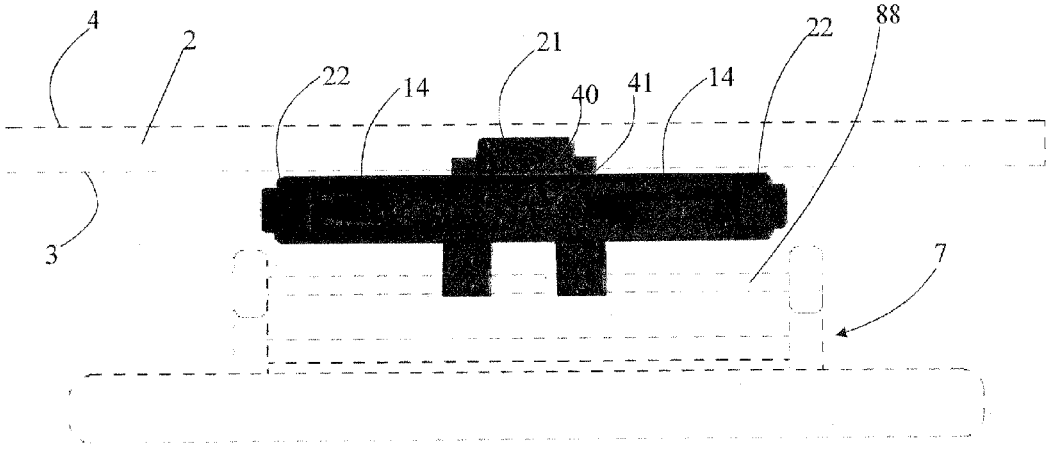
FIG. 5 shows a front view of the improved ironing board with the legs in the folded-up configuration and the transportation means in the projecting position.
Figure 2:
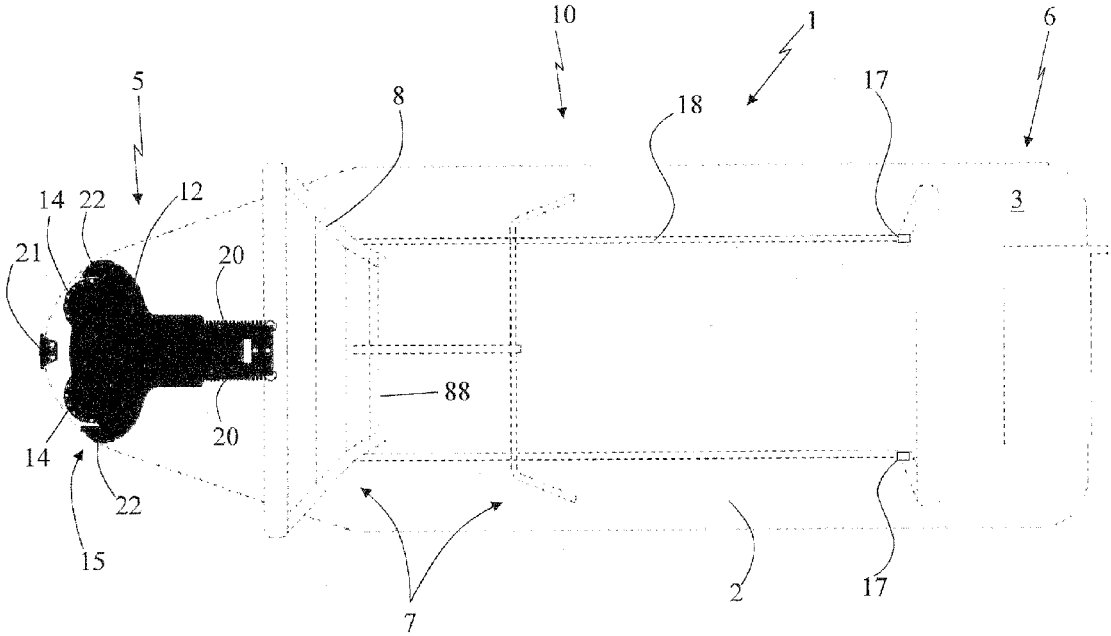
FIG. 2 shows a bottom view of the improved ironing board with the legs in the open configuration and the transportation means in the retracted position.
Figure 3:
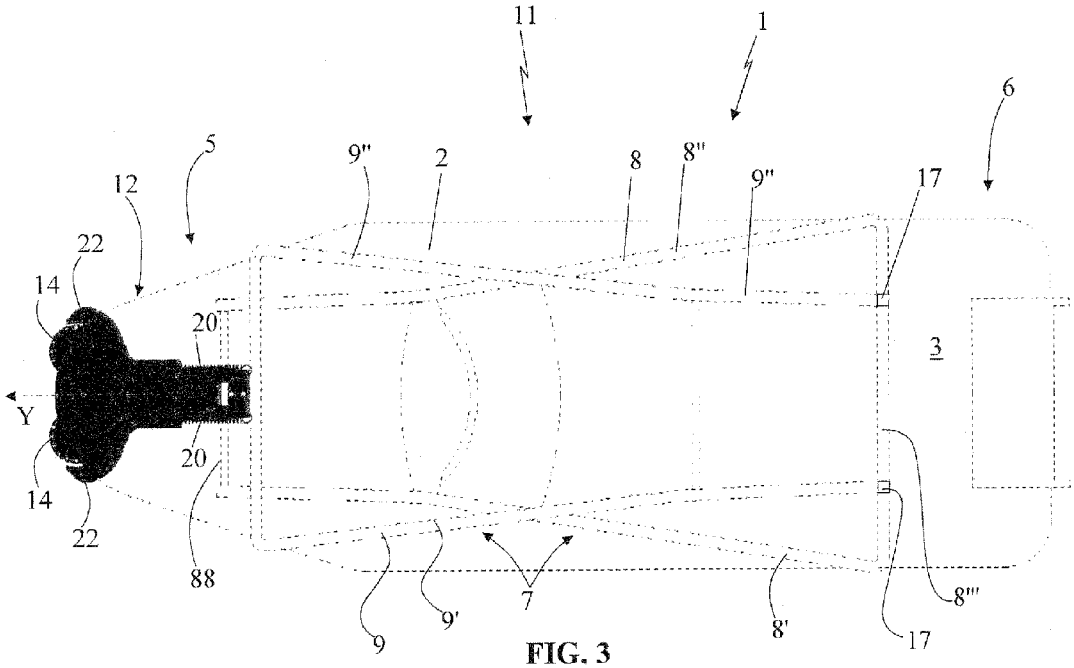
FIG. 3 shows a bottom view of the improved ironing board with the legs in the folded-up configuration and the transportation means in the projecting position.
Figure 6:
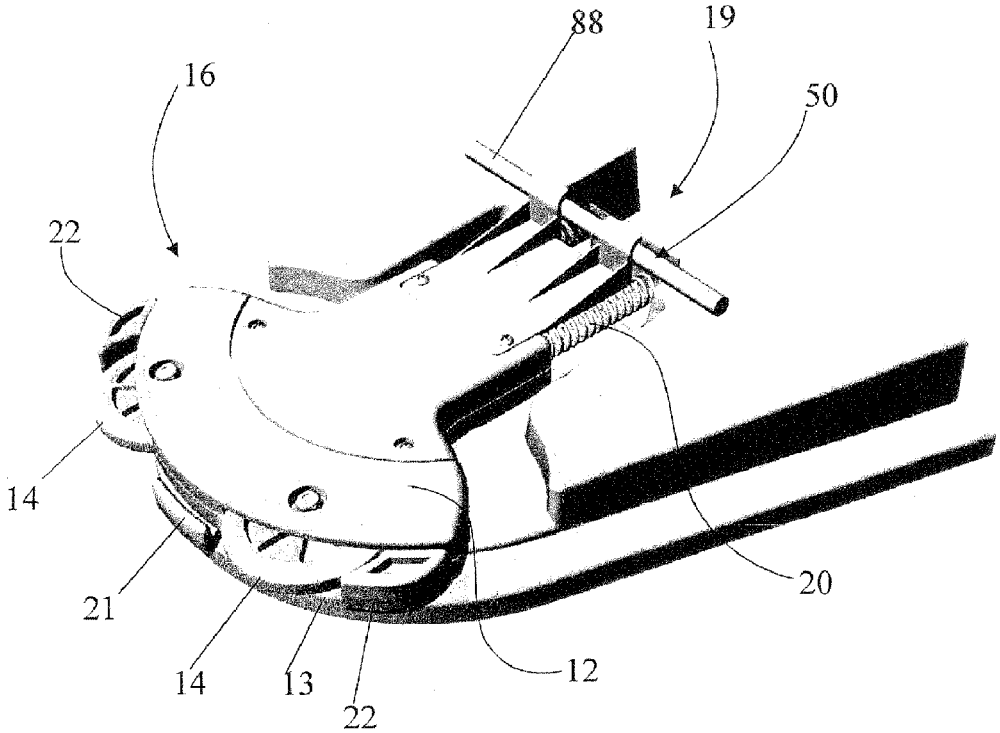
FIG. 6 shows an enlarged detail of the improved ironing board according to the preceding figures, relating to the transportation means.
Figure 4:
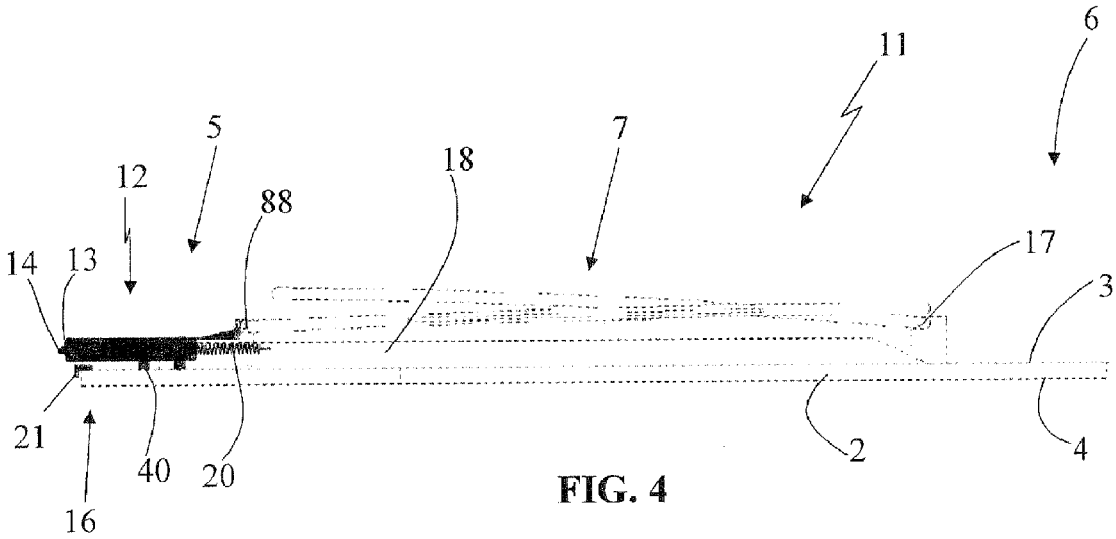
FIG. 4 shows a side view of the improved ironing board with the legs in the folded-up configuration and the transportation means in the projecting position.

In accordance with the figures of the accompanying drawings, 1 denotes in its entirety the ironing board according to the present invention.

In accordance with the example of embodiment of the accompanying figures, the board 1 comprises an ironing surface 2 which has a form which is conventional per se with a main direction of extension along a longitudinal axis (Y).

In greater detail, the surface 2 has a bottom side 3 and a top side 4 intended generally to be lined with a removable ironing cover.

This ironing surface 2 has a front portion 5, with a slightly tapered form, and a rear portion 6, from which a support surface for an iron preferably extends.

The ironing surface 2 is supported by a frame 7 formed by two legs 8, 9, i.e. a first front leg 8 and a second rear leg 9. The frame 7 may be moved manually between an open configuration 10, where it supports the ironing surface 2 in a horizontal working position, and a closed configuration 11 with the legs 8, 9 folded up against the bottom side 3 of the surface 2 for stowing away the ironing board 1, usually in a vertical position resting against a wall.

According to the idea forming the basis of the present invention a carriage 12 is mounted slidably on the bottom side 3 of the ironing surface 2 in the region of the front portion 5 or rear portion 6. The carriage 12 has, mounted on its outer profile 13, two idle wheels 14 with their axes aligned transversely with respect to the longitudinal direction Y of the board 1.

The frame 7, moving between the two configurations, i.e. open configuration 10 and closed configuration 11, correspondingly operates the carriage 12 so that it moves between a retracted position 15, where the wheels 14 are retracted within the contour of the ironing surface 2, and a projecting position 16, where the wheels 14 project from the contour 2 so as to allow displacement of the board resting on the wheels 14.

During its movement the carriage 12 is guided by a T-shaped rail 40 which extends parallel to the longitudinal direction Y of the surface 2, projecting from the bottom side 3 of the latter, so as to engage inside a correspondingly shaped groove 41 formed in the side of the carriage 12 facing the bottom side 3 of the ironing surface 2.

In accordance with the example of embodiment described in the accompanying figures, the carriage 12 is arranged in the front portion 5 of the board 1 even though, obviously, without departing from the scope of protection of the present patent, it may be similarly provided, suitably modified, in the rear portion 6 of the board 1.

In greater detail, according to the illustrative example shown in the accompanying figures, the rear leg 9 consists of a shaped tube formed by two first parallel sections 9' and 9" connected at the top end by means of hinges 17 to the bottom side 3 of the surface 2, and by a first transverse joining member 9'" positioned so as to connect the two parallel sections 9' and 9" at their bottom ends and intended to form a support for resting on the ground.

The front leg 8 also consists of a shaped tube formed by two second parallel sections 8' and 8" which are mechanically connected at the top end to the bottom side 3 of the surface 2 and by a second transverse joining member 8'" positioned so as to connect the two second parallel sections 8' and 8" at their bottom ends and intended to form a support for resting on the ground.

Two parallel rails 18 are provided, directed in said longitudinal direction Y on the bottom side 3 of the surface 2. The rails 18 guide the sliding of a third transverse joining member 88 positioned so as to connect the sections 8' and 8" at their top end for a displacement parallel to the ironing surface 2 during displacement of the frame 7 between the two configurations 10 and 11, namely during opening and closing of the front leg 8.

In other words, and more clearly while the ea-r leg 9 passes between the two open and closed configurations 10,11, rotating about the hinge 17, the front leg 8 must perform a rotary/translatory movement with the third transverse joining member 88 which slides inside the rails 18 parallel to the side 3 of the surface 2.

In greater detail, when the frame 7 is in the closed configuration 11, the third joining member 88 of the front leg 8 is situated in the front portion 5 while the second joining member 8'" is situated in the rear portion 6.

By opening the front leg 8, the third joining member 88 slides inside the rails 18, being displaced towards the rear portion 6, while the second joining member 8'" rotates towards the front portion 5.

The third joining member 88 is able to bear against a seat 50 provided in the rear part 19 of the carriage 12 so as to push it into the projecting position 16 during closing of the frame 7, overcoming the resistive force of resilient means preferably formed by a pair of springs 20.

The latter are advantageously fixed at one end to the bottom side 3 of the surface 2 and at the other end to the rear part 19 of the carriage 12. Therefore, the springs 20 are able to push resiliently the carriage 12 towards the retracted position 15.

The wheels 14 preferably have axes of rotation which are parallel to each other and perpendicular to the ie of the ironing surface 2.

A projecting member 21 is fixed to the end of the front portion 5 of the ironing surface 2, in a middle position with respect to the transverse width of the surface 2, equidistant from the two wheels 14, and has mainly the function of allowing resting on the ground without dirtying the board covering cloth. Therefore, this cloth will have a special opening which is positioned opposite the abovementioned projecting member 21, so as to allow the latter to emerge from the cloth.

The carriage 12 is also provided, on the side of the two wheels 14, with support points 22 which prevent the board 1 from slipping on the ground when it is inclined excessively during transportation. In particular, these support points interfere with the ground when there are angles of inclination A of the longitudinal axis Y relative to the ground of less than 40°.

The invention therefore achieves the objects proposed, obtaining the advantages illustrated above in comparison with the known solutions.

The invention claimed is:

1. Improved ironing board which comprises:

an ironing surface which has a main direction of extension along a longitudinal axis (Y) and delimits a bottom side and a top side for ironing and at the ends a front portion and a rear portion;

a frame able to support the ironing surface, comprising at least one first leg and one second leg and able to be moved between an open configuration where it supports the ironing surface in the working position and a closed configuration with the legs folded up against the bottom side of the board for stowing away the ironing board;

characterized in that it comprises at least one carriage mounted slidably on the bottom side of the ironing board at one of its ends, provided with at least one idle mounted wheel and operated by the movement of the frame so as to be displaced between a retracted position with the frame open, where the wheel retracts substantially into the contour of the ironing surface, and a projecting position, with the frame closed, where the wheel projects from the contour of the ironing surface so as to allow displacement of the board resting on the wheel.

2. Ironing board according to claim 1, in which at least two said wheels are provided, mounted on said carriage with their axes aligned transversely with respect to said longitudinal direction (Y).

3. Ironing board according to claim 2, in which a projecting member is provided on the end of said ironing surface with said associated carriage, being preferably arranged in a middle position with respect to the transverse extension of said surface and equidistant from said two wheels.

4. Ironing board according to claim 1, in which said frame comprises at least one leg which has a bottom end intended to rest on the ground and a top end mechanically connected to the bottom side of said ironing surface and which moves parallel to said bottom surface during displacement of the frame between said open and closed configurations.

5. Ironing board according to claim 4, in which said top end pushes said carriage into a projecting position during displacement of said frame into the closed configuration.

6. Ironing board according to claim 5, in which resilient means are envisaged for pushing said carriage from said projecting position into said retracted position.

7. Ironing board according to claim 2, in which support points are provided on the side of the two wheels and are able to interfere with the ground when the axis is inclined with the longitudinal axis (Y) beyond a given angle of inclination relative to the ground.

* * * * *